US006222464B1

(12) United States Patent
Tinkel et al.

(10) Patent No.: US 6,222,464 B1
(45) Date of Patent: Apr. 24, 2001

(54) SELF COMPENSATING TARGET ACQUISITION SYSTEM FOR MINIMIZING AREAS OF THREAT

(75) Inventors: Jack Byron Tinkel, Westport; Jeffrey Paul Rios, Beacon Falls; Stephen H. Silder, Monroe, all of CT (US)

(73) Assignee: Sikorsky Aircraft Corporation, Stratford, CT (US)

( * ) Notice: Subject to any disclaimer, the term of this patent is extended or adjusted under 35 U.S.C. 154(b) by 0 days.

(21) Appl. No.: 09/453,326

(22) Filed: Dec. 2, 1999

(51) Int. Cl.[7] ..... G08B 21/00

(52) U.S. Cl. ..... 340/945; 340/961; 340/970; 342/29

(58) Field of Search ..... 340/945, 961, 340/963, 968, 970; 342/65, 29; 701/4, 14, 301

(56) References Cited

U.S. PATENT DOCUMENTS

| | | | | |
|---|---|---|---|---|
| 4,433,323 | * | 2/1984 | Grove | 340/970 |
| 4,849,756 | * | 7/1989 | Bateman | 340/970 |
| 4,903,216 | | 2/1990 | Huss et al. | 364/518 |
| 5,086,396 | | 2/1992 | Waruszewski, Jr. | 364/454 |
| 5,179,638 | | 1/1993 | Dawson et al. | 395/125 |
| 5,194,734 | * | 3/1993 | Whittaker et al. | 250/338.1 |
| 5,526,260 | | 6/1996 | Kodet et al. | 364/423 |
| 5,630,035 | | 5/1997 | Gjullin et al. | 395/127 |
| 5,631,640 | | 5/1997 | Deis et al. | 340/961 |
| 5,787,333 | | 7/1998 | Rasinski et al. | 434/4 |
| 5,823,780 | * | 10/1998 | Arye et al. | 434/38 |
| 5,884,222 | * | 3/1999 | Denoize et al. | 340/970 |
| 5,892,462 | * | 4/1999 | Tran | 340/961 |
| 5,969,676 | * | 10/1999 | Tran et al. | 342/13 |

* cited by examiner

*Primary Examiner*—Jeffery Hofsass
*Assistant Examiner*—John Tweel, Jr.
(74) *Attorney, Agent, or Firm*—Seidel, Gonda, Lavorgna & Monaco, PC

(57) ABSTRACT

A method of automated scan compensation in a target acquisition system for reducing areas of potential threat surrounding an aircraft. The target acquisition system is located on an aircraft and adapted to receive data from a plurality of sensors. The target acquisition system includes a scanning device with adjustable scan limits for scanning a desired area in the vicinity of the aircraft. The method involves determining the aircraft's current position, altitude, and heading. The terrain in the vicinity of the aircraft is then scanned and a line of sight between the aircraft and the scanned terrain is determined. Changes in the terrain which prevent other areas of the terrain in the vicinity of the aircraft from being scanned are also determined. The method then involves determining adjustments to the scan limits on the target acquisition system to reduce the size of the unscanned areas, and adjusting the scan limits as the aircraft flies over the terrain.

12 Claims, 6 Drawing Sheets

SMART SEARCH SEQUENCE

SELF COMPENSATING TARGET ACQUISITION SYSTEM FOR MINIMIZING AREAS OF THREAT

FIELD OF THE INVENTION

The present invention relates to a target acquisition system for an aircraft and, more particularly, to an improved system for actively scanning a flight path to minimize areas of potential threat to the aircraft.

BACKGROUND OF THE INVENTION

Modern reconnaissance/attack aircraft are designed with various on-board systems for conducting intelligent automated search of the terrain being overflown. These systems are designed to minimize the burden on the flight crew when making tactical decisions by analyzing the vast amount and constantly changing sources of data associated with the aircraft's current state. For example, conventional navigation systems, particularly those employing GPS, provide real time, three dimensional coordinates in the near earth airspace where the aircraft is operating. Digital database maps provide aircraft personnel with detailed terrain data in the vicinity of the aircraft.

Today's aircraft also include target acquisition systems (TAS) that provide range, resolution, fast scanning and computerized detection and classification of targets/threats around the aircraft. These systems are designed to search large surface areas in very short times.

The primary drawback to conventional aircraft search/scanning systems is the ability to recognize both the constraints and requirements of the information provided. For example, current target acquisition systems do not take into account system constraints, such as clear line of sight, TAS turret rotational velocities and accelerations, image processing rates, aircraft velocity and height above terrain. The conventional systems also do not take into account the mission requirements, such as expected threat capabilities and the nature of a mission (e.g., reconnaissance, assault or recovery). Only when the constraints and requirements are balanced in real time can the terrain search be optimized for mission goals, whether those goals are information gathering, survivability or time of transit.

FIG. 1 illustrates a conventional automatic scanning technique, such as a target detection system, as used in present day aircraft. The aircraft scans the terrain with either a single or two bar sweep defined by triangular zone A. (A single scan generally uses a preset set mid-range scan of the terrain to determine what is in front of the aircraft. A two bar scan uses both a long range scan and a short range scan to image the terrain). Once elevation and azimuthal limits are programmed into the system, the turret is locked into a scan pattern that can only compensate for aircraft pitch attitude changes, i.e., if the aircraft pitches downward, the TAS adjusts upward to maintain constant azimuthal and elevational scan limits. The conventional systems are not able to automatically compensate for variations in terrain or changes in tactical situations.

Often, due to the low altitude regime that helicopters operate in and because of rolling terrain, the aircraft will come upon terrain that quickly slopes down or up. In these cases, without intervention from the pilot, gaps occur in the terrain being searched. In the case of down slopes, due to fixed elevation limits, the aircraft could easily overfly the depression without ever detecting whether targets of interest are located in the area. The deficiency in the prior scanning system is illustrated in FIG. 1A where the forward looking scan from the aircraft does not detect the bottom of the depression (the shaded area). Similarly, an up sloped region, such as a hill shown in FIG. 1B, results in decreased detection range since the fixed elevation limits cause the sensor to look into a hillside rather than scanning upwards to the hill crest. As such, the aircraft will not detect a threat at the top of the hill until the aircraft is almost upon it. Also, as the scan passes over the crest, the vertical elevation of the hill obscures a portion of the terrain directly behind it. This poses another threat to the aircraft.

A need therefore exists for an automated search system that takes into account system constraints and requirements.

SUMMARY OF THE INVENTION

The present invention relates to a method of automated scan compensation in a target acquisition system for reducing areas of potential threat surrounding an aircraft. The target acquisition system is located on the aircraft and adapted to receive data from a plurality of sensors. The target acquisition system includes a scanning device with adjustable scan limits for scanning a desired area in the vicinity of the aircraft.

The method involves determining the aircraft's current position, altitude, and heading. The terrain in the vicinity of the aircraft is then examined so that a line of sight between the aircraft and the terrain scanned by the target acquisition system can be determined. Changes in the terrain which prevent other areas of the terrain in the vicinity of the aircraft from being scanned are also determined.

The method then involves determining adjustments to the scan limits on the target acquisition system to reduce the size of the unscanned areas, and adjusting the scan limits as the aircraft flies over the terrain.

The present invention is designed to reduce the workload on the crew while minimizing the potential threats to which the aircraft is exposed during flight due to failure or delay in detecting the threats.

The foregoing and other features and advantages of the present invention will become more apparent in light of the following detailed description of the preferred embodiments thereof, as illustrated in the accompanying figures.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE PREFERRED EMBODIMENTS

Figure 1A:
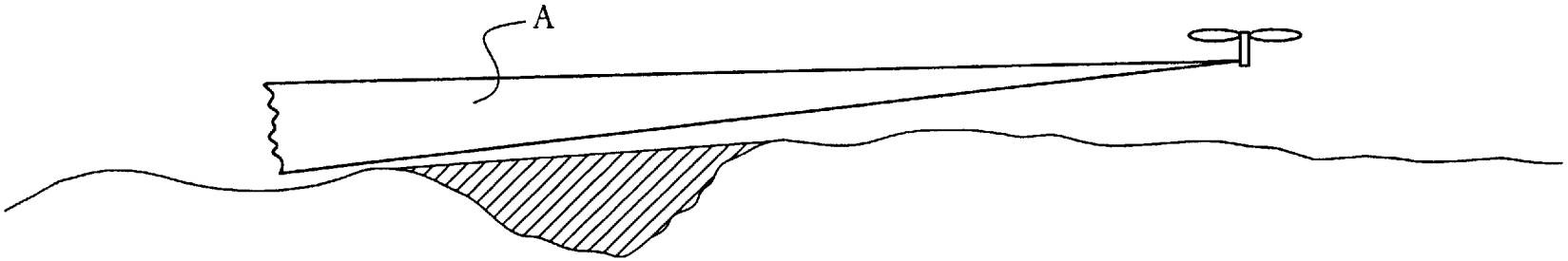
FIG. 1A (PRIOR ART)
FIGS. 1A and 1B are schematic representations of the deficiencies of prior art target acquisition systems.
Figure 1B:
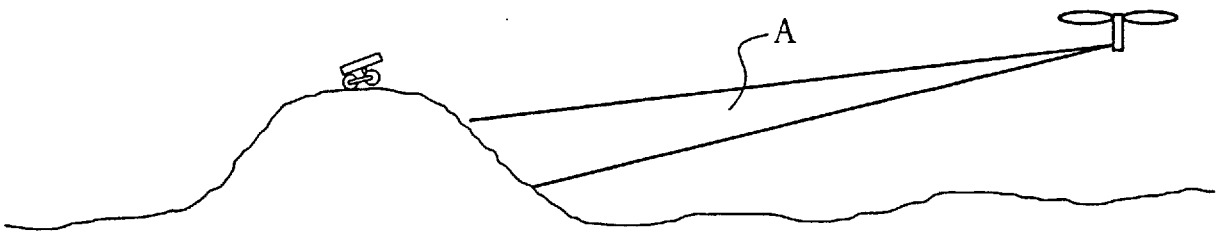
FIG. 1B (PRIOR ART)

While the invention will be described in connection with one or more preferred embodiments, it will be understood that it is not intended to limit the invention to those embodiments. On the contrary, it is intended that the invention cover all alternatives, modifications and equivalents as may be included within its spirit and scope as defined by the appended claims.

Certain terminology is used herein for convenience only and is not to be taken as a limitation on the invention. Particularly, words such as "upper," "lower," "left," "right," "horizontal," "vertical," "upward," and "downward" merely describe the configuration shown in the figures. Indeed, the components may be oriented in any direction and the terminology, therefore, should be understood as encompassing such variations unless specified otherwise.

Referring now to the drawings, wherein like reference numerals illustrate corresponding or similar elements throughout the several views, the improved target acquisition system according to the present invention is illustrated as it is contemplated for use in a rotorcraft. However, the present invention is not limited to such an aircraft but can be used in any aircraft (manned or unmanned) requiring automated search capabilities. FIGS. 2A–2F illustrate the sequence of the scanning technique of the present invention as it is used to scan terrain consisting of both hills and valleys. The hatch marks in the drawings illustrate cumulative areas that have been scanned using the present invention, shown by increased hatched area in each successive illustration from 2A through 2F.

Figure 2A:
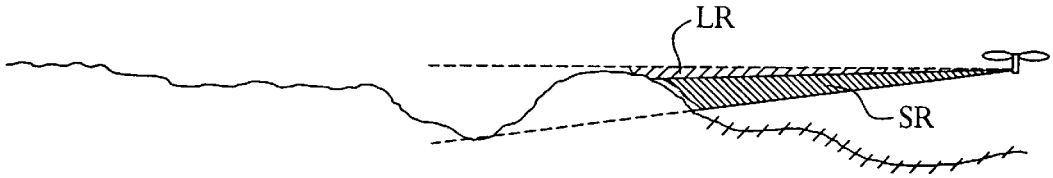
FIGS. 2A–2F are schematic representations of a self compensating target acquisition system according to the present invention.

The avionics of many of today's aircraft are equipped with highly accurate positioning equipment and electronic maps. This equipment is used primarily as navigational aids for the pilot and is also used to provide situational awareness for ownship as well as other friendly assets. These same sensors and databases are used in the present invention to automatically alter a scanning pattern to provide improved coverage. In particular, the present invention includes a two bar scan device, such as the devices manufactured by Lockheed-Martin and Northrop-Grumman, which is incorporated in the target acquisition system (TAS) on the RAH-66 Comanche Aircraft developed by Sikorsky Aircraft Corporation, the assignee of the present invention. In the present invention, the TAS is modified to permit the azimuthal and elevational limits of the long range and short range scans to be varied as needed to accurately and efficiently search the terrain of interest. For example, as shown in FIG. 2A, as the aircraft traverses the terrain, both the long range scan (identified as LR) and the short range scan (identified as SR) operate similar to conventional systems. When the TAS receives data from one of the scans which indicates a terrain change that adversely effects the line of sight of the TAS, such as the hill in FIG. 2A, the long range scan is adjusted to search the top of the hill. The mid range scan continues to scan the remainder of the hill.

Figure 2B:
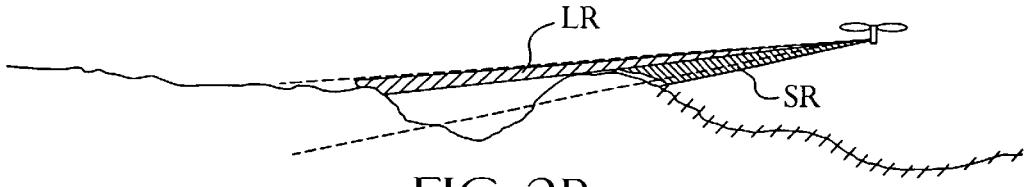

When the TAS detects that the crest of the hill has been scanned (clear line of sight is reacquired) due to forward motion, the long range scan is automatically adjusted to its maximum range so that the terrain immediately beyond the hill is scanned for threats (FIGS. 2B).

Figure 2C:
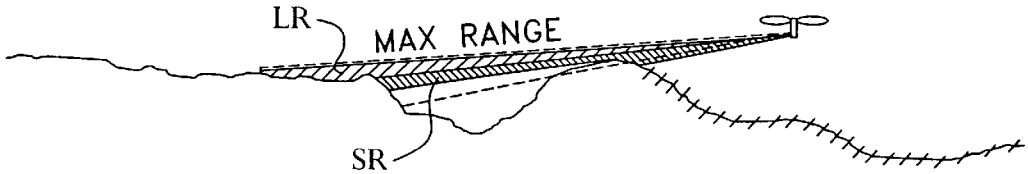
Figure 2D:
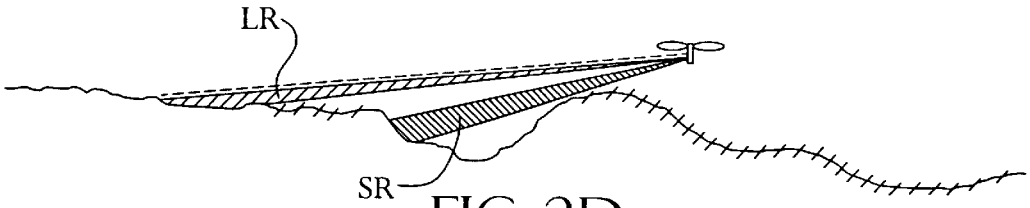
Figure 2E:
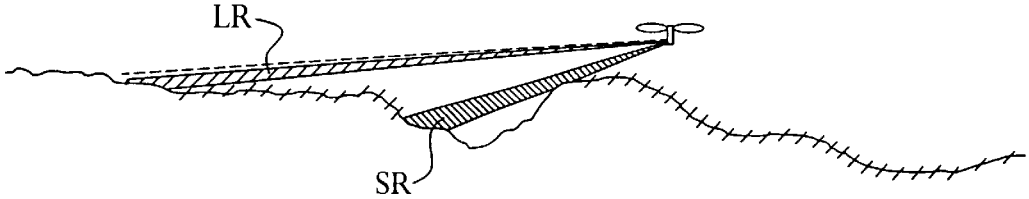
Figure 2F:
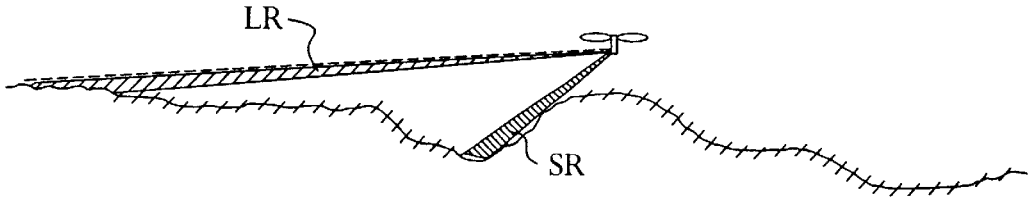

When the short range scan passes the crest of the hill, it also begins to scan the terrain beyond the hill (FIG. 2C). However, the TAS adjusts the elevational limits on the short range scan to cause the short range scan to search the terrain previously unsearched as it become visible (i.e., the land immediately behind the hill). That is, the terrain is scanned closer to the aircraft as the aircraft flies over the hill (FIGS. 2D–2F). At the point when the aircraft passes over hill, the entire terrain behind the hill will have been searched (as indicated by the hatch marks in FIG. 2F). Hence, the TAS system according to the present invention automatically compensates for hidden threats posed by terrain variations by adjusting the elevation limits of the scan pattern based on an analysis of the terrain.

Figure 3:
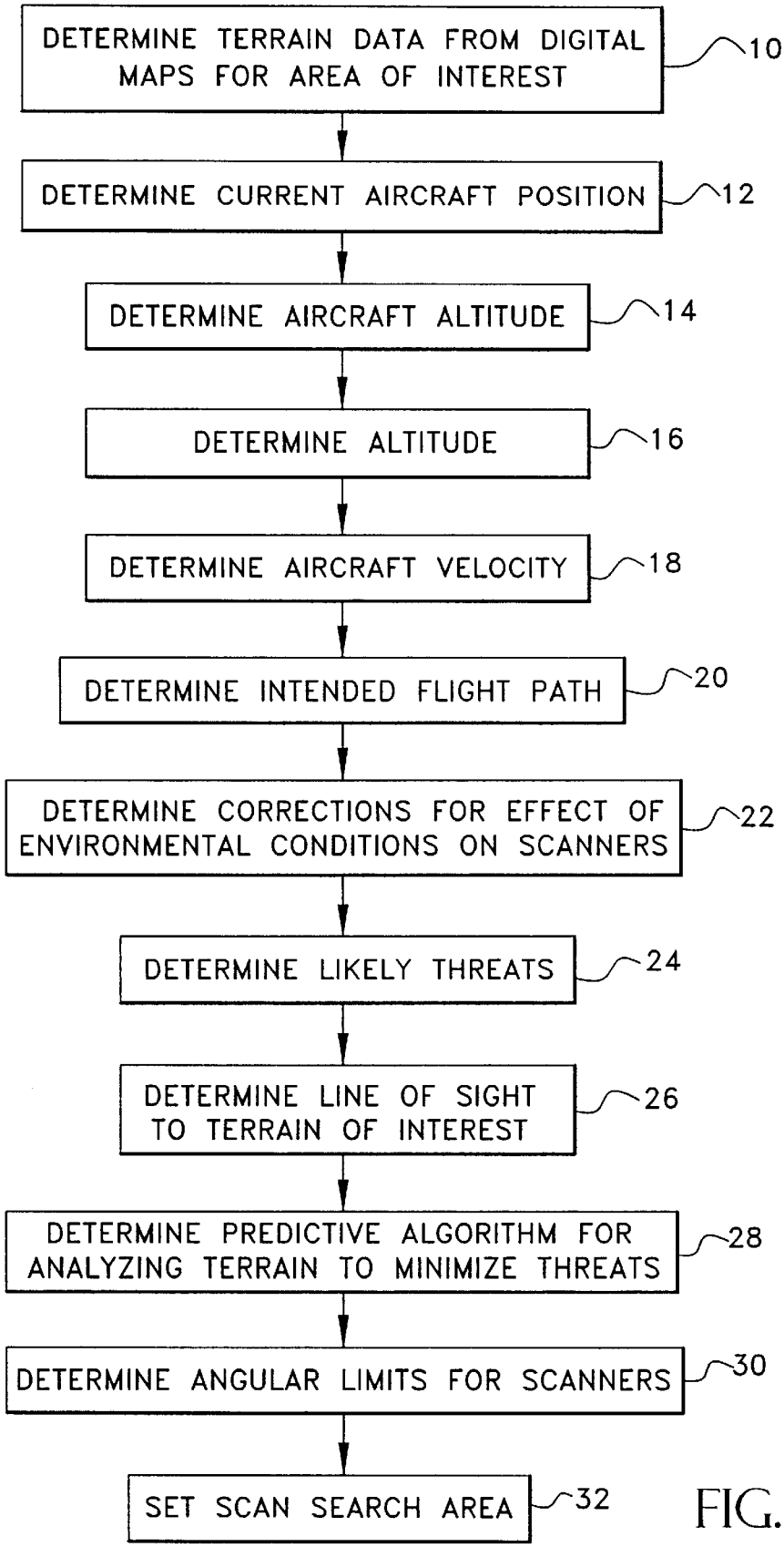
FIG. 3 is a flow chart of the self compensating target acquisition system according to the present invention.

The present invention makes use of the technique of intervisibility (i.e., the determination of line of sight to various points between ownship and the ground) to determine, based on various sensed parameters and a predictive algorithm, the proper downlook angle for the scanner. Referring to FIG. 3, a flow chart of the preferred steps for determining the angular adjustment for the scanning device is shown. Those skilled in the art will recognize that the steps need not be practiced in the order shown. First, the TAS determines the appropriate digital terrain data is selected for the area of interest, which typically corresponds to the immediate area through which the aircraft will fly (step 10). The data is picked off of a conventional digital terrain database, which includes data derived from various sources and includes elevation data. The data is typically stored in a M by N grid with a resolution of 10 meters.

On-board navigational sensors, such as a global positioning system and altimeters, provide the aircraft's altitude above the ground, its present position, its heading, and its velocity with respect to the ground (steps 12, 14, 16 and 18). The aircraft's intended flight path is also determined based on the mission plan (step 20) programmed into the flight computer. The environmental conditions are analyzed using conventional sensors to determine their effect on the scanners (step 22). For example, it has been determined that there can be a loss of resolution during high humidity. To determine whether such conditions exist, the present invention contemplates the use of a humidity sensor to provide relevant information that can be used to adjust the system. It is also possible for the TAS to determine if the scanned image is fuzzy (indicating loss of resolution). If the TAS indicates that the image is not clear, the system can take appropriate measures to counter the problem.

Preferably, the aircraft receives information on threats, targets and/or other potential areas of interest (for search and rescue) that are in the vicinity of the aircraft and/or its intended flight path (step 24). The phrase "threats and targets" as used in the present invention is defined as potential sources of harm to the aircraft, such as hostile forces, adverse weather conditions, unknown areas. The information could be supplied from an on-board digital database, transmitted to the aircraft by telemetry, or inputted into the TAS by the pilot. The TAS then determines the line of sight to the terrain of interest (step 26). Various systems exist for determining line-of-sight. For example, the RAH-66 Comanche aircraft utilizes a Forward Looking Infrared (FLIR) system to locate items within its line-of-sight for the TAS, i.e., see in dark or through dust and smoke and to take advantage of heat emanating from people and machines. Currently, this data is used in conventional aircraft to provide a two dimensional display to the crew of terrain that has been searched, including the scan limits.

The TAS according to the present invention utilizes the line-of-sight information to perform an intervisibility determination of what can and cannot be seen by the sensors at the aircraft's current position and predicted position. Intervisibility systems and algorithms are well known in the art, see, for example, U.S. Pat. Nos. 4,903,216, 5,086,396, 5,526,260, and 5,787,333, which are all incorporated by reference herein in their entirety. An intervisibility system was also developed on the Rotorcraft Pilot's Associate (RPA) program under the oversight of the United States Army. Hence, those skilled in the art are readily capable of incorporating a suitable intervisibility system into the present invention and, therefore, no further details on the intervisibility system are needed.

Based on the above parameters, including the intervisibility determination, the location of likely threats, and the aircraft velocity and heading, the system determines the angular adjustments that are necessary to reduce the threats, e.g., reduce the unknown (unscanned) areas (step 30). The adjustment can include varying or altering the scanning limits to minimize the unknown areas. A predictive algorithm is utilized to anticipate changes to the elevation limits and make appropriate adjustments to the scanner (steps 28 and 32).

A variety of artificial intelligence based systems have been developed under various military programs, such as the US Army's D/NAPS and RPA programs, which include expert systems that integrate various on-board and off-board data to determine pilot intent. The present invention utilizes those expert systems to vary the scanning limits.

The hardware and software used in the present invention can also be used to provide additional capabilities to an integrated target acquisition system (TAS). For example, the present invention can be used to optimize settings for parameters used by an automatic target recognition (ATR) system and by an automatic target tracking (ATT) system in real time. The present invention can also be used to determine specific terrain and cultural features that can be used as additional decision variables for an ATR system and an ATT system. It is also contemplated that the present invention can be used to direct and limit the elevation extent of TAS searches cued by defensive electronic systems, such as Aircraft Survivability Equipment (ASE) which include electronic and infrared sensors (to look at emissions from threats), which provide bearing cues and information on enemy threats, but no range data.

The present invention provides a self-compensation system that integrates the functionality of conventional scanning target acquisition systems with the data acquired from on-board navigation sensors and digital maps through the use of artificial intelligence processing. The system also can take into account information from outside sources, such as AWACS and U-2 aircraft. This additional information permits the system to improve the identification of the target or threat and, thus, improve the systems confidence. This can be accomplished by comparing scanned data with the intelligence data from on-board or outside sources.

Figure 4:
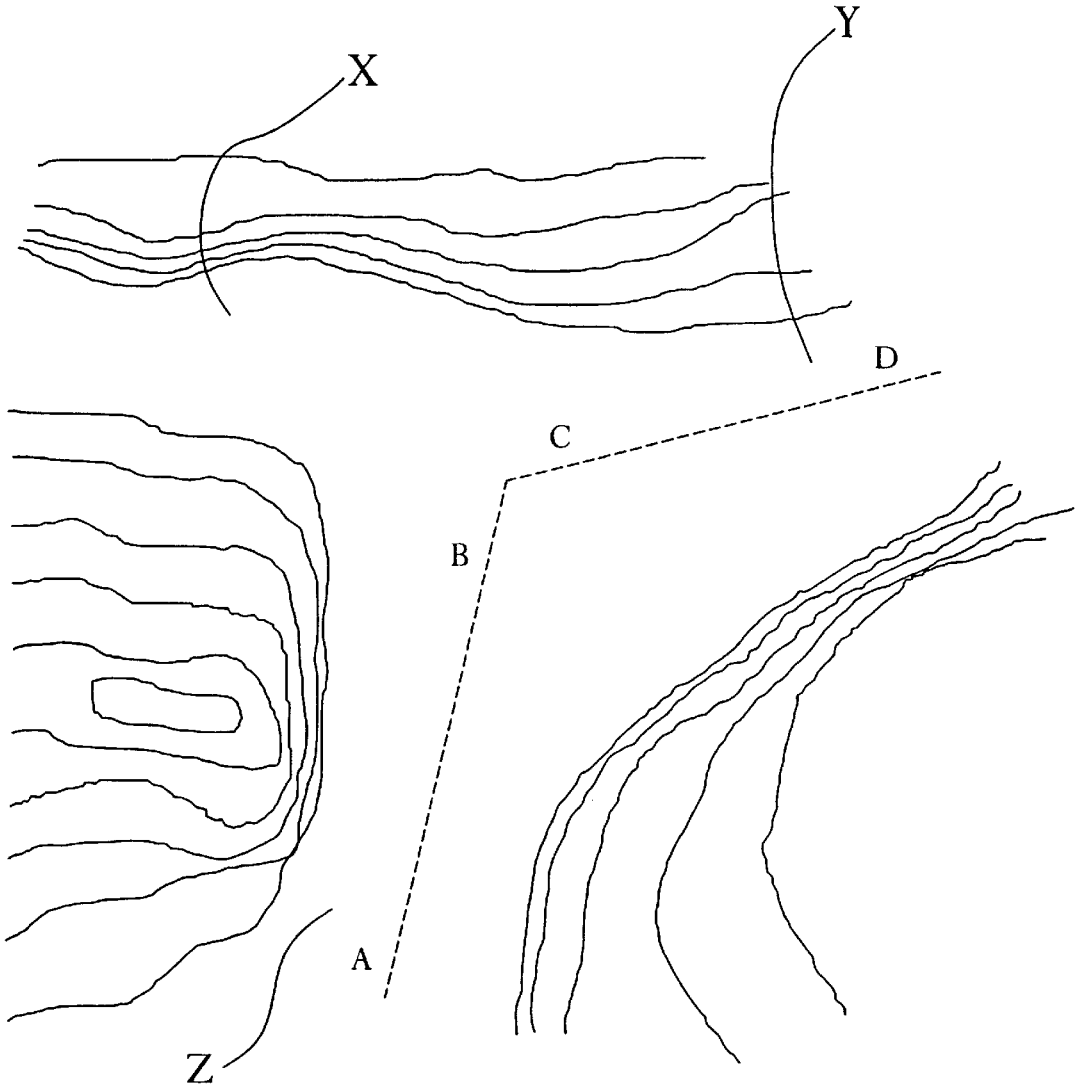
FIG. 4 is a schematic representation of an intended flight path for an aircraft through a valley.

The present invention is not limited to increasing the downward looking capability of the scan. On the contrary, the present invention can also be applied to the azimuthal scan limits. Data, such as flight path intent and knowledge of likely threat emplacements, can be used to support azimuthal adjustments of the TAS scan pattern. An example is illustrated in FIG. 4. The dashed line AB, BC, CD represents the flight path of the aircraft through a valley or river bed where it comes upon an intersection. Using the present invention, the aircraft's velocity, position and heading relative to the surrounding terrain is used to narrow the azimuthal scan limits while the aircraft is flying along the first leg of the flight (segment AB). By narrowing the azimuthal limits, quicker and more thorough scanning of the terrain is possible. Also, the shorter scan time allows the system to adjust the elevational scan limits, if necessary, so that the crests on each side of the valley floor can be searched for items of interest.

Based on the intended flight path and knowledge of existing threats, the TAS can be set to scan the region most likely to contain threats first, and even prioritize the threats. For example, the TAS can be adjusted to search either the left or the right valley when the intersection at point B is reached. As the aircraft unmasks and flies through the intersection, the line of sight to the terrain is continuously calculated and the TAS scan limits adjusted.

As noted above, the system can prioritize the threats. For example, the intended flight path CD is along valley Y in FIG. 4 which is in a direction that is away from valley X. As such, any threats along valley X are of lower priority than the threats along valley Y. The expert system takes this into account when adjusting the scan rate and limits for the TAS.

It is also contemplated that the type of scanning desired can be predetermined. For example, if the terrain can support long range threats (i.e., surface to air missiles), then an appropriate scan can be automatically selected. In FIG. 4, the steep valley walls on the left side of valley Z would prevent the use of long range weaponry, while the less steep slopes on the right side of valley Z could support such weaponry. The scan rate and limits could be automatically adjusted to account of this terrain profile.

Figure 5:
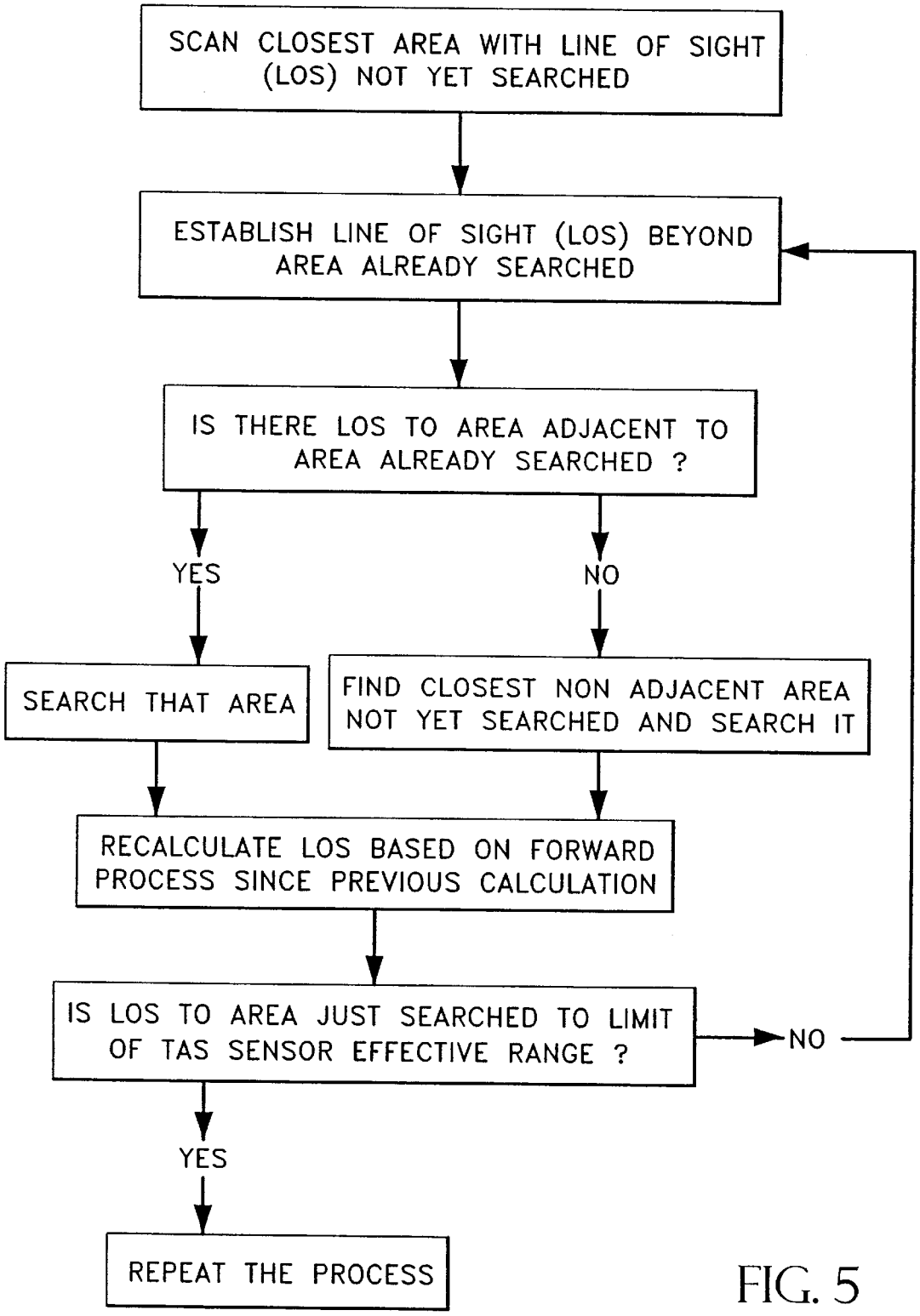
FIG. 5 is a flow chart of a smart search sequence according to one aspect of the invention.

FIG. 5 is a logic flow chart for a smart search sequence according to the present invention. In this case, the azimuth search limits are fixed, rather than conditional as discussed above.

Figure 6:
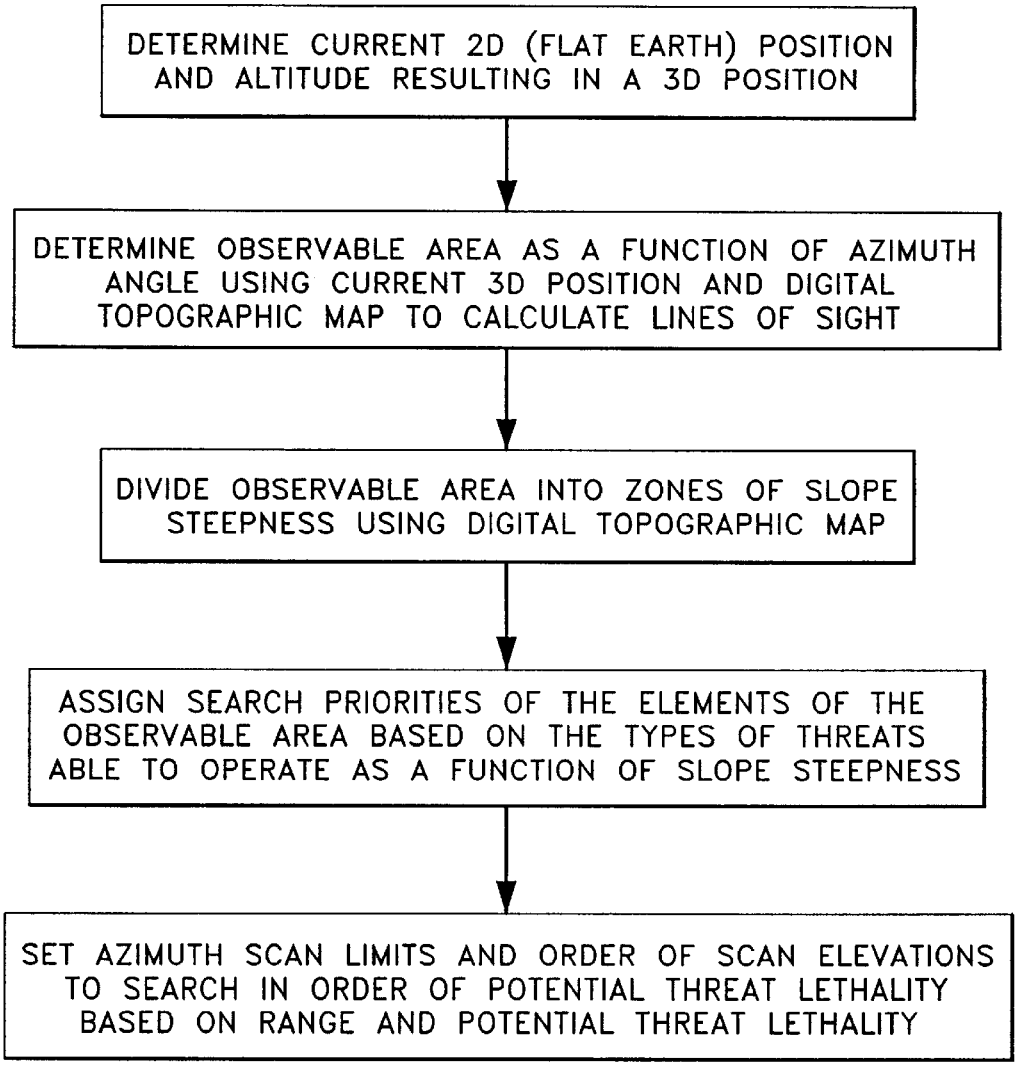
FIG. 6 is a flow chart of an azimuth scan technique according to one aspect of the invention.

FIG. 6 is a flow chart for an azimuth smart search sequence according to the present invention. The scan is based on the understanding that observable areas are those to which a line of sight exists, i.e., is not blocked from the current position of the observer by some obstacle. The scan is also based on the understanding that steeper slopes are less accessible to heavy vehicles which are, generally, the most dangerous threats.

As should be readily apparent, one of the benefits of the present invention, in addition to reducing the workload of the crew, is to provide a more efficient and timely scan of the terrain. This reduces the acquisition timeline which directly effects survivability of the air vehicle. Also, the system is capable of taking advantage of past behavior of sensed threats by tracking speed, and analyzing the terrain to determine likely direction of travel of the threat (i.e., vehicles favor roads). From this information, the reasonableness of a threat can be determined and, if the threat is not likely to exist because it conflicts with past behavior or likely capabilities, the threat can be automatically downgraded.

The present invention can also be used before a detailed terrain search is started in order to determine the best flight plan for the aircraft to follow to minimize unscanned areas or threats.

Although the invention has been described and illustrated with respect to the exemplary embodiments thereof, it should be understood by those skilled in the art that the foregoing and various other changes, omissions and additions may be made therein and thereto, without parting from the spirit and scope of the present invention.

What is claimed is:

1. A method of automated scan compensation in a target acquisition system for reducing areas of potential threat surrounding an aircraft, the target acquisition system being located on the aircraft and adapted to receive data from a plurality of sensors, the target acquisition system including a device for scanning a desired area in the vicinity of the aircraft, the device having adjustable scan limits, the method comprising the steps of:

determining the aircraft's current position;

determining the aircraft's current altitude;

determining the aircraft's current heading;

scanning the terrain in the vicinity of the aircraft;

determining a line of sight between the aircraft and the scanned terrain;

determining changes in the terrain which prevent other areas of the terrain in the vicinity of the aircraft from being scanned;

determining adjustments to the scan limits on the target acquisition system to reduce the size of the unscanned areas; and adjusting the scan limits as the aircraft flies over the terrain.

2. A method of automated scan compensation according to claim 1 further comprising the step of determining existing environmental conditions which may effect the scanning resolution.

3. A method of automated scan compensation according to claim 2 wherein the step of determining the environmental conditions involves determining the current humidity level.

4. A method of automated scan compensation according to claim 1 wherein the aircraft's current heading is determined based on a predetermined mission plan.

5. A method of automated scan compensation according to claim 1 wherein the step of determining the changes in the terrain which prevent other areas of the terrain in the vicinity of the aircraft from being scanned involves analyzing a digital terrain map.

6. A method of automated scan compensation according to claim 1 the step of determining adjustments to scan limits includes determining whether the terrain minimizes the likelihood of a threat and, adjusting the scan limits based on at least that determination.

7. A method of automated scan compensation in a target acquisition system for reducing areas of potential threat surrounding an aircraft, the target acquisition system being located within a computer on the aircraft and adapted to receive data from a plurality of sensors, the target acquisition system including a device for scanning a desired area in the vicinity of the aircraft, the device having adjustable scan limits, the method comprising the steps of:

selecting data from a digital terrain database representing the terrain in the vicinity of the aircraft;

determining the aircraft's current position;

determining the aircraft's current altitude;

determining the aircraft's current heading;

determining a line of sight between the aircraft and the terrain data from the terrain database;

determining changes in the terrain in the vicinity of the aircraft which prevent areas of the terrain in the vicinity of the aircraft from being scanned because of terrain obstructions;

determining adjustments to the scan limits on the target acquisition system to reduce the size of the unscanned areas; and adjusting the scan limits as the aircraft flies over the terrain.

8. A method of automated scan compensation according to claim 7 further comprising the step of determining existing environmental conditions which may effect the scanning resolution.

9. A method of automated scan compensation according to claim 8 wherein the step of determining the environmental conditions involves determining the current humidity level.

10. A method of automated scan compensation according to claim 7 wherein the aircraft's current heading is determined based on a predetermined mission plan.

11. A method of automated scan compensation according to claim 7 wherein the step of determining the changes in the terrain which prevent other areas of the terrain in the vicinity of the aircraft from being scanned involves analyzing the selected data from the digital terrain database.

12. A method of automated scan compensation according to claim 7 the step of determining adjustments to scan limits includes determining whether the terrain minimizes the likelihood of a threat and, adjusting the scan limits based on at least that determination.

* * * * *